US009695845B2

(12) United States Patent
Funato

(10) Patent No.: US 9,695,845 B2
(45) Date of Patent: Jul. 4, 2017

(54) FLUID PRESSURE CYLINDER

(71) Applicant: KAYABA INDUSTRY CO., LTD., Tokyo (JP)

(72) Inventor: Hiroshi Funato, Gifu (JP)

(73) Assignee: KYB Corporation, Tokyo (JP)

( * ) Notice: Subject to any disclaimer, the term of this patent is extended or adjusted under 35 U.S.C. 154(b) by 544 days.

(21) Appl. No.: 14/387,235

(22) PCT Filed: Feb. 21, 2013

(86) PCT No.: PCT/JP2013/054277

§ 371 (c)(1),
(2) Date: Sep. 22, 2014

(87) PCT Pub. No.: WO2013/140934

PCT Pub. Date: Sep. 26, 2013

(65) Prior Publication Data

US 2015/0040754 A1 Feb. 12, 2015

(30) Foreign Application Priority Data

Mar. 23, 2012 (JP) ..... 2012-067080

(51) Int. Cl.
*F15B 15/22* (2006.01)
*F01B 11/02* (2006.01)

(52) U.S. Cl.
CPC ..... *F15B 15/222* (2013.01); *F01B 11/02* (2013.01)

(58) Field of Classification Search
CPC ..... F15B 15/22; F15B 15/227; F15B 15/222; F01B 11/02
See application file for complete search history.

(56) References Cited

U.S. PATENT DOCUMENTS

2006/0151269 A1* 7/2006 Ikeda ..... F15B 15/222 188/267

FOREIGN PATENT DOCUMENTS

| | | | |
|---|---|---|---|
| JP | 60-021522 Y2 | | 6/1985 |
| JP | 04-038094 Y2 | | 9/1992 |
| JP | 05-045206 U | | 6/1993 |
| JP | 11-230117 A | | 8/1999 |
| JP | 2000274409 A | * | 10/2000 |
| JP | 2001-082415 A | | 3/2001 |

* cited by examiner

*Primary Examiner* — Logan Kraft
*Assistant Examiner* — Abiy Teka
(74) *Attorney, Agent, or Firm* — Rabin & Berdo, P.C.

(57) ABSTRACT

A cushion mechanism for decelerating a piston rod includes a holder fastened to an end surface of a cylinder portion fitted with an inner peripheral surface of a cylinder tube, a plurality of fastening bolts for fastening the holder to the cylinder portion, an annular entry portion provided on the piston rod and advancing into the holder and the cylinder portion in the vicinity of the stroke end, a cushion passage formed by penetrating at least one of the plurality of fastening bolts and allowing a working chamber and a discharge port to communicate with each other and leading a working fluid in the working chamber to a discharge port, and an orifice portion provided on the cushion passage and applying resistance to a flow of the working fluid.

8 Claims, 4 Drawing Sheets

FLUID PRESSURE CYLINDER

TECHNICAL FIELD

The present invention relates to a fluid pressure cylinder used as an actuator.

BACKGROUND ART

A hydraulic cylinder used for a hydraulic excavator or the like is generally provided with a cushion mechanism for decelerating a piston rod by generating a cushion pressure in the vicinity of a stroke end of the piston rod.

As this type of hydraulic cylinders, JP2001-82415A discloses a hydraulic cylinder in which a passage 15 extending from a working chamber 9 toward a port 11 and a reducing hole 18 allowing an opening portion 17 and the passage 15 to communicate and playing a role of limiting a flow rate of a working fluid in the working chamber 9 and discharging it toward a port 11 are formed in a fitting portion 3 of a first covering member 2 closing an end-surface opening by covering a cylinder tube 1, and a cushion ring 19 is provided on the piston rod 6 adjacent to the piston 5. The cushion ring 19 plays a role of closing a diameter-enlarged hole 13*a* when the piston rod 6 moves to a direction of discharging the working fluid in the working chamber 9 by being fitted in the diameter-enlarged hole 13*a* in the vicinity of its movement end. As a result, the working fluid in the working chamber 9 is discharged toward the port 11 via the reducing hole 18 from the opening portion 17 while its flow rate is limited, and a cushion action is applied at the movement end of the piston rod 6.

SUMMARY OF INVENTION

In the hydraulic cylinder described in JP2001-82415A, when cushioning performances are to be adjusted, it is necessary to remove the first covering member from a cylinder tube and to adjust the diameter of the reducing hole. If the diameter of the reducing hole is to be enlarged, machining for enlarging the diameter of the reducing hole is needed, while if the diameter of the reducing hole is to be reduced, the first covering member itself needs to be changed.

The present invention was made in view of the above-described problems and has an object of providing a fluid pressure cylinder which can adjust cushion performances easily.

According to an aspect of the present invention, a fluid pressure cylinder of which a piston rod to which a piston is fastened is provided capable of reciprocating in a cylinder tube includes, a closing member for closing an end opening portion of the cylinder tube, a working chamber defined between the closing member and the piston, a supply/discharge port formed in the closing member and communicating with the working chamber, and a cushion mechanism for decelerating the piston rod in the vicinity of a stroke end when a working fluid in the working chamber is discharged through the supply/discharge port and the piston rod makes a stroke, the cushion mechanism includes a cylinder portion fitted with an inner peripheral surface of the cylinder tube, an annular holder fastened to an end surface of the cylinder portion, a plurality of fastening bolts each for fastening the holder to the cylinder portion, an annular entry portion provided annularly on the piston rod and advancing into the holder and the cylinder portion in the vicinity of the stroke end, a discharge port formed in the cylinder portion and communicating with the supply/discharge port, a cushion passage formed by penetrating at least one of the plurality of fastening bolts and allowing the working chamber and the discharge port to communicate with each other and leading the working fluid in the working chamber to the discharge port when the annular entry portion enters into the holder and the cylinder portion, and an orifice portion provided in the cushion passage and applying resistance to a flow of the working fluid.

Embodiments and advantages of the present invention will be explained below in detail by referring to the attached drawings.

DESCRIPTION OF EMBODIMENTS

A hydraulic cylinder 1 as a fluid pressure cylinder according to an embodiment of the present invention will be explained by referring to the attached drawings.

The hydraulic cylinder 1 is used as an actuator mounted on a construction machine or an industrial machine. For example, the hydraulic cylinder 1 is used as an arm cylinder mounted on a hydraulic excavator, and an arm of the hydraulic excavator is rotationally moved by a telescopic operation of the hydraulic cylinder 1.

Figure 1:
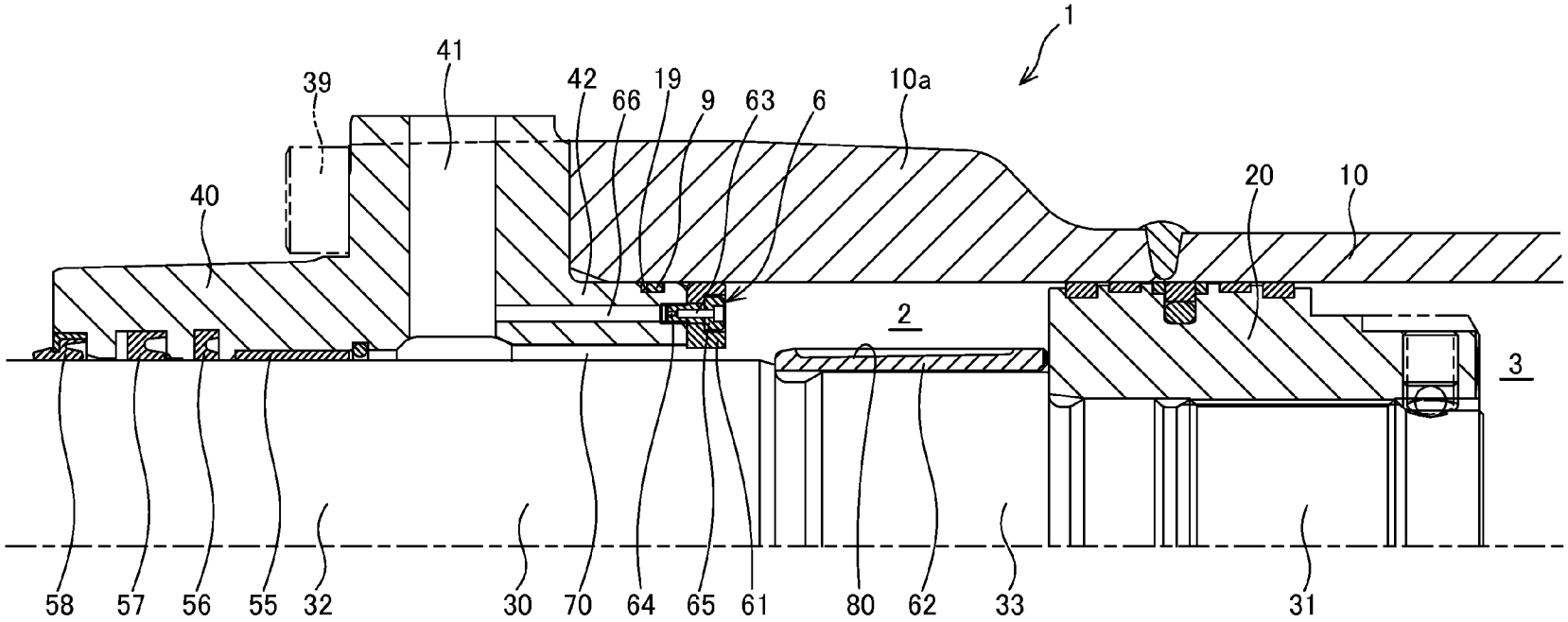
FIG. 1 is a sectional view of a fluid pressure cylinder of an embodiment of the present invention and illustrates a state in which a piston rod is in a stroke region in which a cushion action by a cushion mechanism is not exerted.
Figure 2:
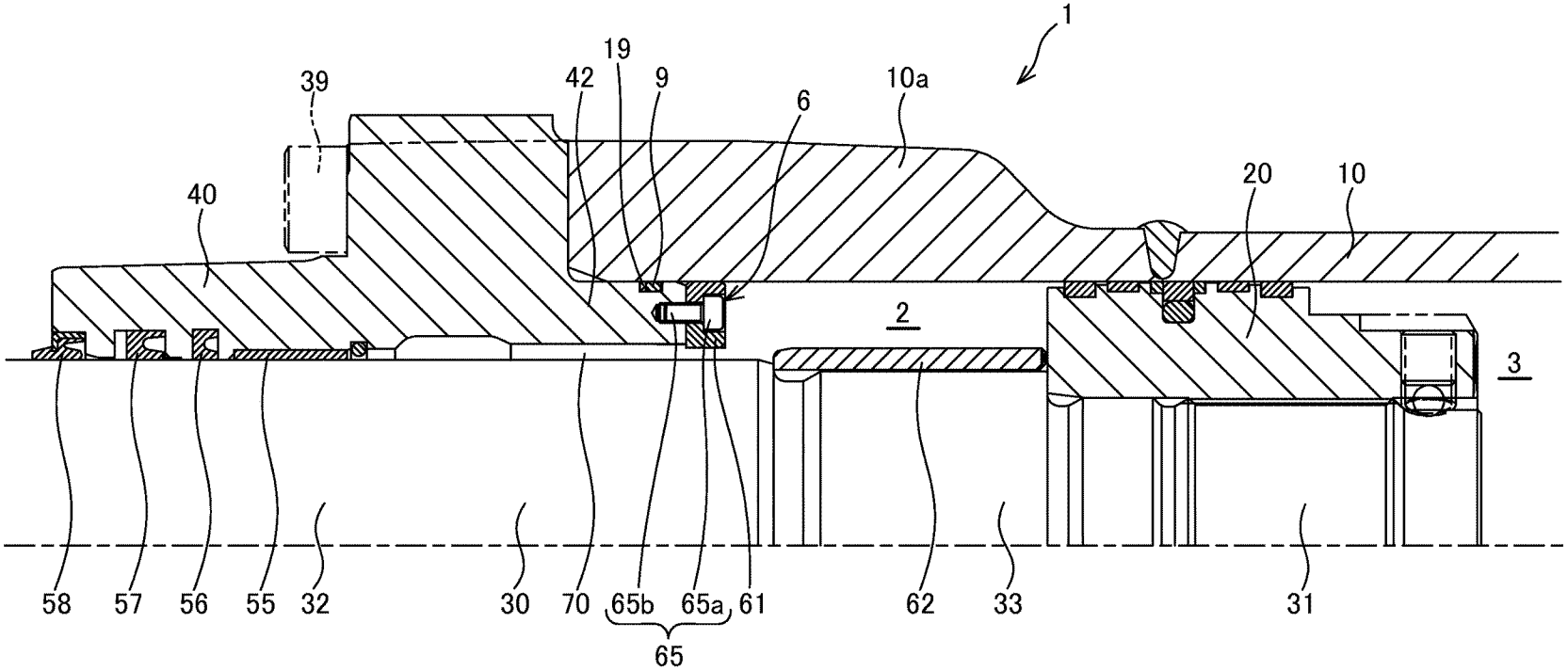
FIG. 2 is a sectional view of the fluid pressure cylinder of the embodiment of the present invention and illustrates a state in which the piston rod is in the stroke region in which the cushion action by the cushion mechanism is not exerted, showing a section different from that in FIG. 1.

As illustrated in FIGS. 1 and 2, the hydraulic cylinder 1 includes a cylindrical cylinder tube 10, a piston 20 slidably inserted into the cylinder tube 10 and dividing an inside of the cylinder tube 10 into a rod-side chamber 2 as a working chamber and a counter-rod-side chamber 3, and a piston rod 30 reciprocating in the cylinder tube 10 and having one end thereof connected to the piston 20 and the other end extending to an outside of the cylinder tube 10.

The rod-side chamber 2 and the counter-rod-side chamber 3 communicate with a hydraulic pump as a hydraulic-pressure supply source or a tank through a switching valve. When one of the rod-side chamber 2 and the counter-rod-side chamber 3 communicate with the hydraulic pump, the other communicates with the tank. The hydraulic cylinder 1 is telescopically operated when a working oil (working fluid) is led to the rod-side chamber 2 or the counter-rod-side chamber 3 from the hydraulic pump, whereby the piston rod 30 is moved in an axial direction. A working fluid such as an aqueous substitution liquid or the like, for example, may be used instead of oil.

The end opening portion of the cylinder tube 10 is closed by a cylinder head 40 as a closing member. The piston rod 30 is slidably inserted through the cylinder head 40 and is supported by the cylinder head 40. The cylinder head 40 is a substantially cylindrical member and is fastened to a flange portion 10*a* formed on an end portion of the cylinder tube 10 by a bolt 39.

On an inner peripheral surface of the cylinder head 40, a bearing 55, a sub seal 56, a main seal 57, and a dust seal 58 are juxtaposed and interposed, and they are brought into sliding contact with an outer peripheral surface of the piston rod 30. The bearing 55 supports the piston rod 30 so that the piston rod 30 can move in an axial direction of the cylinder tube 10.

On the cylinder head 40, a supply/discharge port 41 communicating with the rod-side chamber 2 is formed. A hydraulic pipeline is connected to the supply/discharge port 41, and the hydraulic pipeline is connected to the hydraulic pump or the tank through the switching valve.

Moreover, on the cylinder head 40, a cylinder portion 42 fitted with the inner peripheral surface of the cylinder tube 10 is formed. On an outer peripheral surface of the cylinder portion 42, an O-ring 9 and a backup ring 19 for sealing a space from the inner peripheral surface of the cylinder tube 10 are interposed. The cylinder portion 42 may be provided separately from the cylinder head 40.

The piston rod 30 includes a small-diameter portion 31 formed on a tip end portion and to which the piston 20 is fastened, a large-diameter portion 32 sliding with the inner peripheral surface of the cylinder head 40 and having a diameter larger than that of the small-diameter portion 31, and a medium-diameter portion 33 formed between the small-diameter portion 31 and the large-diameter portion 32 and on which an annular cushion ring 62 which will be described later is provided. A diameter of the medium-diameter portion 33 is larger than that of the small-diameter portion 31 and smaller than that of the large-diameter portion 32. The cushion ring 62 is not removed from the piston rod 30 since it is sandwiched between the piston 20 and the large-diameter portion 32.

When the hydraulic pump communicates with the rod-side chamber 2, and the tank communicates with the counter-rod-side chamber 3, the working oil is supplied to the rod-side chamber 2 through the supply/discharge port 41, and the working oil in the counter-rod-side chamber 3 is discharged to the tank. As a result, the piston rod 30 moves to a right direction in FIG. 1, and the hydraulic cylinder 1 performs a contraction operation.

Figure 3:
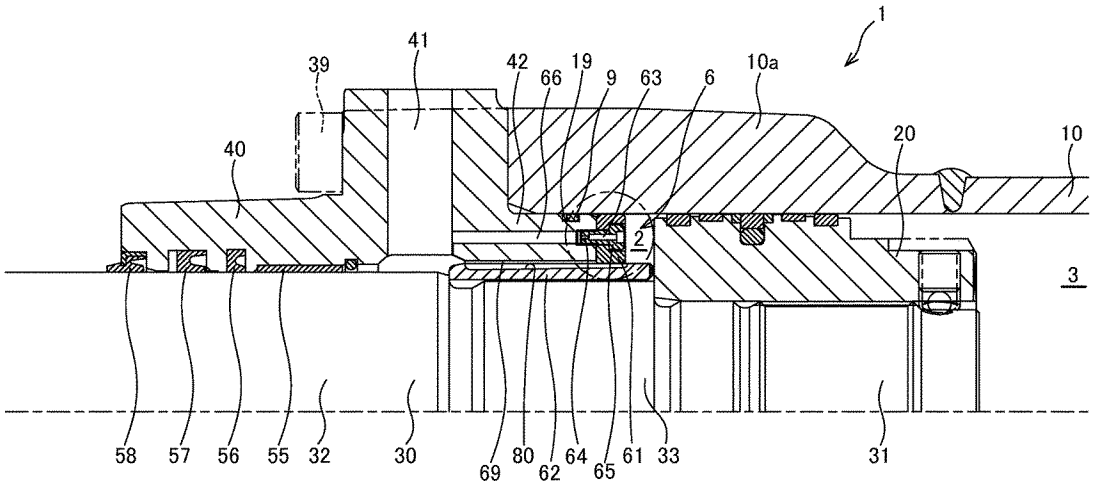
FIG. 3 illustrates a state in which the piston rod is located in the vicinity of a stroke end when the fluid pressure cylinder performs an extension operation.

On the other hand, when the hydraulic pump communicates with the counter-rod-side chamber 3, and the tank communicates with the rod-side chamber 2, the working oil is supplied to the counter-rod-side chamber 3, and the working oil in the rod-side chamber 2 is discharged to the tank through the supply/discharge port 41. As a result, the piston rod 30 moves to a left direction in FIG. 1, and the hydraulic cylinder 1 performs extension operation. The hydraulic cylinder 1 is provided with the cushion mechanism 6 for decelerating the piston rod 30 in the vicinity of a stroke end during an extension operation. FIGS. 1 and 2 illustrate a state in which the piston rod 30 is in a normal stroke region, and the cushion mechanism 6 does not exert a cushion action. FIG. 3 illustrates a state in which the piston rod 30 is in the vicinity of the stroke end during the extension operation of the hydraulic cylinder 1, and the cushion mechanism 6 exerts the cushion action.

The cushion mechanism 6 will be explained below in detail by referring mainly to FIGS. 3 and 4.

The cushion mechanism 6 includes an annular holder 61 fastened to an end surface of the cylinder portion 42 of the cylinder head 40, a plurality of fastening bolts 65 each fastening the holder 61 to the cylinder portion 42, a cushion ring 62 as an annular entry portion provided on the medium-diameter portion 33 of the piston rod 30 and advancing into the holder 61 and the cylinder portion 42 in the vicinity of the stroke end, a discharge port 66 formed on the cylinder portion 42 and communicating with the supply/discharge port 41, a cushion passage 63 formed by penetrating at least one of the plurality of fastening bolts 65 so as to allow the rod-side chamber 2 and the discharge port 66 to communicate and leading the working oil of the rod-side chamber 2 to the discharge port 66 when the cushion ring 62 enters into the holder 61 and the cylinder portion 42, and an orifice portion 64 provided on the cushion passage 63 and applying resistance to the flow of the working oil.

The holder 61 is arranged by being juxtaposed with the cylinder portion 42 along the inner peripheral surface of the cylinder tube 10.

Figure 4:
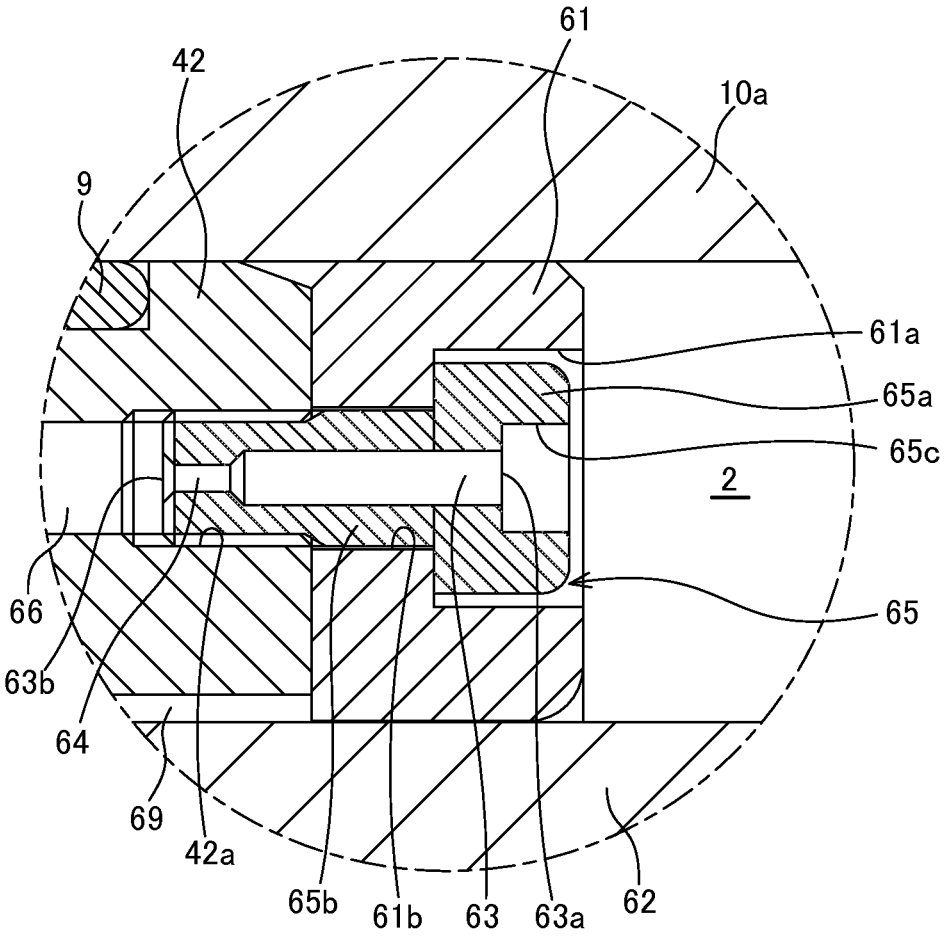
FIG. 4 is an enlarged view of a portion surrounded by a one-dot chain line in FIG. 3.

As illustrated in FIG. 4, the fastening bolt 65 is formed of a head part 65*a* having an engagement hole 65*c* with which a mounting tool is engaged and a fastening portion 65*b* of which a male screw is formed on an outer peripheral surface on a tip end side.

On the holder 61, an accommodating hole 61*a* opened toward the rod-side chamber 2 and accommodating the head part 65*a* of the fastening bolt 65 and a through hole 61*b* having a diameter smaller than that of the accommodating hole 61*a* and penetrating the holder 61 in the axial direction are formed. The accommodating holes 61*a* and the through holes 61*b* are formed in plural in a circumferential direction of the holder 61. On an end surface faced with the holder 61 in the cylinder portion 42, a plurality of fastening holes 42*a* corresponding to the through holes 61*b* of the holder 61 are formed. A female screw is formed on an inner peripheral surface of the fastening hole 42*a*.

When the holder 61 is to be fastened to the cylinder portion 42, the fastening portion 65*b* of the fastening bolt 65 is inserted through the through hole 61*b* of the holder 61 so as to be screwed in the fastening hole 42*a* of the cylinder portion 42 and tightened until the head part 65*a* is brought into contact with a bottom surface of the accommodating hole 61*a*. As a result, the holder 61 is pressed onto the end surface of the cylinder portion 42 by an axial force of the fastening bolt 65 and fastened. In this way, the holder 61 is fastened to the cylinder portion 42 by the plurality of fastening bolts 65.

The cushion ring 62 is formed so that an outer diameter thereof is larger than an outer diameter of the large-diameter portion 32 of the piston rod 30. Therefore, when the piston rod 30 is located in the normal stroke region during the extension operation of the hydraulic cylinder 1, as illustrated in FIGS. 1 and 2, the working oil of the rod-side chamber 2 is led to the supply/discharge port 41 through an annular passage 70 defined between the outer peripheral surface of the large-diameter portion 32 and the inner peripheral surfaces of the holder 61 and the cylinder portion 42 and discharged. On the other hand, when the piston rod 30 is in the vicinity of the stroke end during the extension operation of the hydraulic cylinder 1, as illustrated in FIG. 3, the cushion ring 62 having the diameter larger than that of the large-diameter portion 32 enters into the holder 61 and the cylinder portion 42 and thus, a pressure in the rod-side chamber 2 rises, and the piston rod 30 is decelerated. In this way the cushion action is exerted. Hereinafter, the pressure in the rod-side chamber 2 during a cushion operation when the cushion action is exerted will be referred to as a "cushion pressure".

During the cushion operation, the working oil of the rod-side chamber 2 is discharged to the supply/discharge port 41 through the cushion passage 63 formed in the fastening bolt 65 and having the orifice portion 64. Therefore, the cushion pressure can be adjusted by changing an orifice diameter of the orifice portion 64. If the cushion pressure is to be adjusted by the orifice, it is hardly subjected to viscosity of the working oil, and thus, an advantage that the cushion performance is made stable can be obtained.

The holder 61 is preferably formed so that the outer peripheral surface of the cushion ring 62 slides on the inner peripheral surface thereof. As a result, when the cushion ring 62 enters into the holder 61, the working oil of the rod-side chamber 2 scarcely flows into a space between the inner peripheral surface of the holder 61 and the outer peripheral surface of the cushion ring 62 but flows into the cushion passage 63 of the holder 61, and the cushion passage 63 having the orifice portion 64 can be made as a main passage.

As illustrated in FIG. 4, the cushion passage 63 is formed by penetrating the head part 65*a* of the fastening bolt 65 and the fastening portion 65*b* straightforward in the axial direction. An opening portion 63*a* on one end side of the cushion passage 63 communicates with the rod-side chamber 2 through the engagement hole 65*c*, and an opening portion 63*b* on the other end side communicates with the discharge port 66.

The orifice portion 64 is formed having a diameter smaller than the other portions on a part of the cushion passage 63 and throttles the flow of the working oil.

The cushion passage 63 is formed in at least one of the plurality of fastening bolts 65. The fastening bolt 65 in which the cushion passage 63 is formed is to have functions of both a fastening mechanism for fastening the cylinder portion 42 and the holder 61 and an orifice mechanism of becoming an oil channel when the cushion is operating so as to apply resistance the flow of the working oil.

Adjustment of the cushion performances is executed by replacing the fastening bolt 65 having the orifice portion 64 with the fastening bolt 65 having a desired orifice diameter.

The discharge port 66 is formed on the cylinder portion 42 so that the fastening hole 42*a* to which the fastening bolt 65 having the cushion passage 63 is fastened and the supply/discharge port 41 communicate with each other.

During the cushion operation, the working oil of the rod-side chamber 2 flows into the cushion passage 63 formed in the fastening bolt 65, passes through the orifice portion 64, and is discharged to the supply/discharge port 41 from the discharge port 66.

As illustrated in FIG. 3, a notch 80 in which a channel sectional area gradually decreases as the piston rod 30 goes closer to the stroke end is preferably formed on the outer peripheral surface of the cushion ring 62. By forming the notch 80 on the outer peripheral surface of the cushion ring 62, the working oil of the rod-side chamber 2 flows through the cushion passage 63 and is discharged to the supply/discharge port 41 through the discharge port 66 and also flows to the notch 80 and is discharged to the supply/discharge port 41 during the cushion operation. In this case, it is preferably configured such that a gap between the outer peripheral surface of the cushion ring 62 and the inner peripheral surface of the holder 61 becomes as small as possible and the outer peripheral surface of the cushion ring 62 slides on the inner peripheral surface of the holder 61, and the working oil flows mainly through the cushion passage 63. That is, it is preferably configured such that a flow rate discharged through the cushion passage 63 is larger than the flow rate discharged through the notch 80. By configuring as above, the cushion passage 63 having the orifice portion 64 becomes the main passage. Thus, adjustment of cushion performances can be made mainly by the orifice which is hardly subjected to viscosity of the working oil, and cushion performances can be made stable. On the other hand, the adjustment of the cushion performances according to the stroke of the piston rod 30 is made by adjusting a width and a depth of the notch 80.

According to the above-described embodiment, the following effects are exerted.

The cushion passage 63 which leads the working oil from the rod-side chamber 2 to the supply/discharge port 41 during the cushion operation is formed by penetrating the fastening bolt 65 which fastens the holder 61 to the cylinder portion 42, and the orifice portion 64 is provided on the cushion passage 63. Thus, adjustment of the cushion performances can be made only by replacing the fastening bolt 65 having the orifice portion 64 with one having a desired orifice diameter. As described above, in adjustment of the cushion performances, the cushion performances can be easily adjusted without requiring machining for increasing the orifice diameter or replacing a cylinder head.

Moreover, since machining of the orifice is applied to the fastening bolt which is a small component, machining accuracy of the orifice is improved, and a manufacturing cost can be reduced at the same time.

Furthermore, a component on which the orifice portion 64 is formed also functions as a component for fastening the holder 61 to the cylinder portion 42, and the number of fastening bolts 65 can be reduced, and the fastening bolts 65 can be arranged at equal intervals in the circumferential direction of the holder 61.

Moreover, adjustment of the cushion performances is made by changing the orifice diameter by replacing the fastening bolt 65 having the orifice portion 64. Since the orifice is hardly subjected to viscosity of the working oil, the cushion performances can be made stable as compared with the prior-art method of adjusting the cushion performances by an annular gap 69 between the outer peripheral surface of the cushion ring 62 and the inner peripheral surface of the cylinder portion 42. Moreover, in the prior-art method of adjusting the cushion performances by the annular gap 69, the cushion performances are subjected to machining accuracy of the outer peripheral surface of the cushion ring 62 and the inner peripheral surface of the cylinder portion 42, coaxiality of the cushion ring 62 and the cylinder portion 42 and the like and varied and cannot be made stable easily. However, in this embodiment, the adjustment of the cushion performances is made by changing the orifice diameter, and variation in the cushion performances is suppressed, and the cushion performances can be made stable.

A variation of this embodiment is illustrated below.

In the above-described embodiment, the cushion ring 62 is configured to be provided in the medium-diameter portion 33 of the piston rod 30. Instead, the cushion ring 62 may be abolished, and the medium-diameter portion 33 may be formed to have an outer diameter larger than that of the large-diameter portion 32 of the piston rod 30. However, in this case, there is a concern that the outer peripheral surface of the medium-diameter portion 33 is caught by the holder 61 or the inner peripheral surface of the cylinder portion 42, and a stroke of the piston rod 30 is interfered during the cushion operation. On the other hand, as in the above-described embodiment, in the configuration in which the cushion ring 62 is provided in the medium-diameter portion 33 of the piston rod 30, by configuring such that the cushion ring 62 is floating-supported so as to be slightly movable in a radial direction with respect to the piston rod 30, the outer peripheral surface of the cushion ring 62 can be prevented from being caught by the holder 61 or the inner peripheral surface of the cylinder portion 42. Thus, provision of the cushion ring 62 on the medium-diameter portion 33 of the piston rod 30 is more preferable than formation of the medium-diameter portion 33 so as to have an outer diameter larger than that of the large-diameter portion 32 of the piston rod 30.

Moreover, in the above-described embodiment, the discharge port 66 is formed on the cylinder portion 42 so as to communicate with the supply/discharge port 41. Instead, the discharge port 66 may be formed so as to communicate with the annular gap 69 between the outer peripheral surface of the cushion ring 62 and the inner peripheral surface of the cylinder portion 42. That is, the discharge port 66 may be formed so as to communicate with the supply/discharge port 41 through the annular gap 69.

Embodiments of this invention were described above, but the above embodiments are merely examples of applications of this invention, and the technical scope of this invention is not limited to the specific constitutions of the above embodiments.

For example, in the above-described embodiment, the example in which the hydraulic cylinder is attached to the hydraulic excavator is illustrated, but the hydraulic cylinder may be attached to other construction machines.

The invention claimed is:

1. A fluid pressure cylinder of which a piston rod fastened to a piston is provided capable of reciprocating in a cylinder tube, comprising:

a closing member adapted to close an end opening portion of the cylinder tube;

a working chamber defined between the closing member and the piston;

a supply/discharge port formed in the closing member and communicating with the working chamber; and a cushion mechanism adapted to decelerate the piston rod in the vicinity of a stroke end when a working fluid in the working chamber is discharged through the supply/discharge port and the piston rod makes a stroke, wherein the cushion mechanism includes:

a cylinder portion fitted with an inner peripheral surface of the cylinder tube;

an annular holder fastened to an end surface of the cylinder portion;

a plurality of fastening bolts each adapted to fasten the holder to the cylinder portion;

an annular entry portion provided annularly on the piston rod and advancing into the holder and the cylinder portion in the vicinity of the stroke end;

a discharge port formed in the cylinder portion and communicating with the supply/discharge port;

a cushion passage formed by penetrating at least one of the plurality of fastening bolts and allowing the working chamber and the discharge port to communicate with each other and leading the working fluid in the working chamber to the discharge port when the annular entry portion enters into the holder and the cylinder portion; and an orifice portion provided in the cushion passage and applying resistance to a flow of the working fluid.

2. The fluid pressure cylinder according to claim 1, wherein when the annular entry portion enters into the holder and the cylinder portion, the discharge port communicates with the supply/discharge port through an annular gap defined between the annular entry portion and the cylinder portion.

3. The fluid pressure cylinder according to claim 2, wherein the holder is formed so that an outer peripheral surface of the annular entry portion slides on an inner peripheral surface thereof.

4. The fluid pressure cylinder according to claim 2, wherein the annular entry portion is a cushion ring provided on an outer peripheral surface of the piston rod; and a notch in which a channel sectional area gradually decreases as the piston rod goes closer to the stroke end is formed on an outer peripheral surface of the cushion ring.

5. The fluid pressure cylinder according to claim 4, wherein the notch is formed so that, when the annular entry portion enters into the holder and the cylinder portion, a flow rate of the working fluid discharged through the cushion passage is larger than the flow rate discharged through the notch.

6. The fluid pressure cylinder according to claim 1, wherein the holder is formed so that an outer peripheral surface of the annular entry portion slides on an inner peripheral surface thereof.

7. The fluid pressure cylinder according to claim 1, wherein the annular entry portion is a cushion ring provided on an outer peripheral surface of the piston rod; and a notch in which a channel sectional area gradually decreases as the piston rod goes closer to the stroke end is formed on an outer peripheral surface of the cushion ring.

8. The fluid pressure cylinder according to claim 7, wherein the notch is formed so that, when the annular entry portion enters into the holder and the cylinder portion, a flow rate of the working fluid discharged through the cushion passage is larger than the flow rate discharged through the notch.

* * * * *